US006244827B1

(12) United States Patent
Popov et al.

(10) Patent No.: US 6,244,827 B1
(45) Date of Patent: Jun. 12, 2001

(54) PUMPING-EJECTION APPARATUS

(76) Inventors: Serguei A. Popov, 4615 Post Oak Pl., Suite 140, Houston, TX (US) 77027; Anatoli M. Doubinski, Flat 96, 6, Volokolamskoe Shosse, Moscow 125080 (RU)

( * ) Notice: Subject to any disclaimer, the term of this patent is extended or adjusted under 35 U.S.C. 154(b) by 0 days.

(21) Appl. No.: 09/242,457

(22) PCT Filed: Jun. 28, 1998

(86) PCT No.: PCT/IB98/00991

§ 371 Date: Feb. 17, 1999

§ 102(e) Date: Feb. 17, 1999

(87) PCT Pub. No.: WO99/01670

PCT Pub. Date: Jan. 14, 1999

(30) Foreign Application Priority Data

Jun. 30, 1997 (RU) ..... 97111119

(51) Int. Cl.[7] ..... F09B 23/08
(52) U.S. Cl. ..... 417/88; 417/313
(58) Field of Search ..... 417/151, 77, 88, 417/76, 65, 87, 313

(56) References Cited

U.S. PATENT DOCUMENTS 3,551,073 * 12/1970 Petrovits ..... 417/151
3,701,264 * 10/1972 Newton ..... 62/191
4,761,970 * 8/1988 MacCracken ..... 417/151
5,343,711 * 9/1994 Kornhauser et al. ..... 62/116
5,980,698 * 11/1999 Abrosimov et al. ..... 203/94

FOREIGN PATENT DOCUMENTS 2048156 11/1995 (RU) .
559098 7/1977 (SU) .
1373906 2/1988 (SU) .
1588925 8/1990 (SU) .
1733714 5/1992 (SU) .

* cited by examiner

*Primary Examiner*—Charles G. Freay
(74) *Attorney, Agent, or Firm*—Mark A. Oathout

(57) ABSTRACT

The present invention pertains to the field of jet technology and essentially relates to a pumping-ejection apparatus including a vacuum-producing device. Further, the apparatus is equipped with a condenser, a jet pump and an additional vacuum-producing device which has a boosting liquid-gas ejector, an outlet separator, an additional pump and an additional condenser. The evacuated medium inlet of the jet pump is connected to the separator, the outlet of the jet pump is connected to the suction side of the pump, the inlet of the jet pump for motive medium is connected to the discharge side of the pump. The inlet of the condenser is connected to the ejector's outlet, outlet of the condenser is connected to the separator. The gas inlet of the boosting ejector is connected to the pipe for discharge of compressed gas, the outlet of the boosting ejector is connected to the inlet of the additional condenser. The outlet separator is connected to the outlet of the additional condenser and to the suction side of the additional pump. The introduced pumping-ejection apparatus exhibits an increased operational reliability.

3 Claims, 1 Drawing Sheet

PUMPING-EJECTION APPARATUS

This application is a 371 of PCT/IB98/00991.

The invention pertains to the field of jet technology and essentially relates to plants for evacuation and compression of gaseous mediums, used for example for distilling various liquid products.

BACKGROUND

An apparatus for compression of various gaseous mediums is known, which comprises a liquid-gas ejector, a pump connected through its discharge side to the liquid inlet of the ejector, and a separator with a pipe for discharge of compressed gas (see SU, certificate of authorship 1373906, cl. F 04 F 5/54,1988).

This apparatus is able to compress various gases using energy of a liquid medium, but it is unable to provide a vacuum in a source of the evacuated gaseous medium. The latter limits the range of application of the apparatus.

The closest analogue of the apparatus introduced in the invention is a pumping-ejection plant, which comprises a source of an evacuated gaseous medium, constituting for example a rectifying column with pipes for feed of a stock product and for discharge of an evacuated gaseous medium (gas-vapor phase) and at least one liquid fraction, and a vacuum-producing device, which is composed of a liquid-gas ejector, a pump and a separator with a pipe for discharge of compressed gas (see RU, patent 2048156, cl. B 01 D 3/10,1995). The gas inlet of the ejector is connected to the pipe for discharge of an evacuated gaseous medium and the discharge side of the pump is connected to the liquid inlet of the ejector.

This apparatus provides a vacuum in the source of the evacuated gaseous medium and compresses the evacuated gaseous medium. However, this apparatus does not ensure complete condensation of easy-condensable components of the evacuated gaseous medium prior to arrival of a gas-liquid mixture formed in the ejector in the separator. This hampers the separation of mediums in the separator and results in the accumulation of dissolved gases in the liquid medium. All of the above reduce the ejector's capacity.

SUMMARY OF THE INVENTION

The present invention is aimed at an increase in operational reliability of the pumping-ejection apparatus by reducing the content of dissolved gases in the liquid medium fed into the ejector's nozzle.

The problem is solved as follows. A pumping-ejection apparatus including a vacuum-producing device, which has a liquid-gas ejector connected through its gas inlet to a pipe for delivery of an evacuated gaseous medium, a pump, whose discharge side is connected to the ejector's liquid inlet, and a separator with a pipe for discharge of compressed gas, is furnished with a condenser, a jet pump and an additional vacuum-producing device. This additional vacuum-producing device has a boosting liquid-gas ejector, an outlet separator, an additional condenser and an additional pump. The evacuated medium inlet of the jet pump is connected to the separator, the outlet of the jet pump is connected to the suction side of the pump, the motive medium inlet of the jet pump is connected to the discharge side of the pump. The inlet of the condenser is connected to the ejector's outlet and the outlet of the condenser is connected to the separator. The gas inlet of the boosting liquid-gas ejector is connected to the pipe for discharge of compressed gas, the liquid inlet of the boosting ejector is connected to the discharge side of the additional pump and the outlet of the boosting ejector is connected to the inlet of the additional condenser. The outlet separator is connected to the outlet of the additional condenser and to the suction side of the additional pump.

The discharge side of the pump can be connected to the additional condenser and to the condenser.

Availability of the additional vacuum-producing device, jet pump and condensers optimises the processes of evacuation of a gaseous medium by a motive liquid, mixing of the two mediums and separation of the liquid and gaseous medium, which take place during operation of the apparatus. Additionally, delivery of the degassed motive liquid into the nozzle of the liquid-gas ejector is provided.

Experiments have shown, that adequate passage of processes of discharge and compression of the gaseous medium and mixing of the motive liquid with the evacuated gaseous medium are very important.

The availability of the condensers, jet pump, additional pump and boosting liquid-gas ejector provides complete mixing of the motive liquid and evacuated gaseous medium with simultaneous compression of the gaseous medium prior to entry of the mediums' mixture into the separator. As a result, it becomes possible to achieve nearly complete condensation of easy-condensable components of the evacuated gaseous medium in the motive liquid. This reduces loading of the separators. Availability of the jet pump at the suction side of the pump ensures operation of the pump in an optimal mode completely excluding the possibility of cavitation regardless of the mode of apparatus operation, i.e. regardless of the pressures in the separator and pipe for delivery of the evacuated gaseous medium. The apparatus with the additional vacuum-producing device comprising the boosting liquid-gas ejector, additional pump, condenser and outlet separator has an extended range of operational capability because a reduced pressure in the separator and consequently at the liquid-gas ejector's outlet results in a deeper vacuum available in a source of the evacuated gaseous medium, for example in a rectifying column or any other evacuated object. The reduced pressure in the separator makes for more intensive degassing of the motive liquid. This process becomes adjustable since the required degree of degassing can be controlled by varying pressure in the separator. This can be used as an additional way for adjusting the mode of operation of the whole apparatus. The connection of the discharge side of the pump to the additional and main condensers and connection of a pipe for delivery of a liquid fraction to the main condenser (the latter takes place if the evacuated object is a rectifying column) allow adjustment of the regime of forming of the liquid-gas mixture during mixing of the motive liquid and evacuated gaseous medium. Renewal or change of the motive liquid both in the main and additional vacuum-producing devices is also possible in this case.

So, due to the described improvements the introduced apparatus exhibits an increased operational reliability.

BRIEF DESCRIPTION OF THE DRAWING

The drawing in FIG. 1 represents a schematic diagram of the described pumping-ejection apparatus.

DETAILED DESCRIPTION

Figure 1:
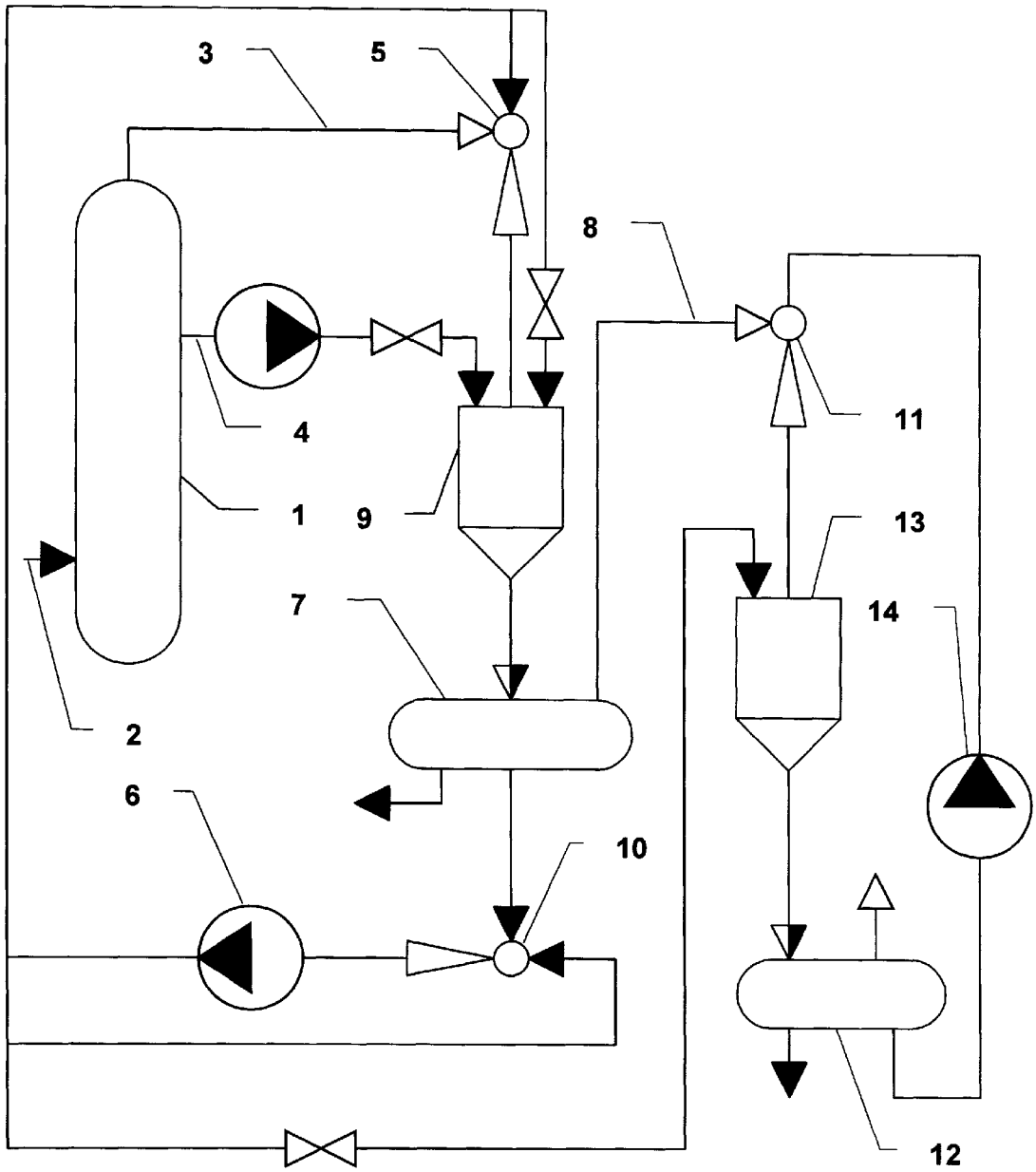

The pumping-ejection apparatus has a source of an evacuated gaseous medium, for example a rectifying column 1 with pipes 2, 3, 4 for respective feed of a stock product, for delivery of the evacuated gaseous medium and for discharge of at least one liquid fraction. The apparatus further includes a vacuum-producing device, which is composed of a liquid-gas ejector 5 connected through its gas inlet to the pipe 3 for delivery of the evacuated gaseous medium, a pump 6 connected through its discharge side to the liquid inlet of the ejector 5 and a separator 7 with a pipe 8 for discharge of compressed gas. The apparatus is equipped with a condenser 9, a jet pump 10 and an additional vacuum-producing device. The latter includes a boosting liquid-gas ejector 11, an outlet separator 12, an additional condenser 13 and an additional pump 14. The evacuated medium inlet of the Jet pump 10 is connected to the separator 7, the outlet of the jet pump is connected to the suction side of the pump 6, the motive liquid inlet of the jet pump 10 is connected to the discharge side of the pump 6. The inlet of the condenser 9 is connected to the outlet of the ejector 5, the outlet of the condenser 9 is connected to the separator 7. The gas inlet of the boosting liquid-gas ejector 11 is connected to the pipe 8 for discharge of compressed gas, the liquid inlet of the ejector 11 is connected to the discharge side of the additional pump 14, the outlet of the ejector 11 is connected to the inlet of the additional condenser 13. The outlet separator 12 is connected to the outlet of the additional condenser 13 and to the suction side of the additional pump 14.

The discharge side of the pump 6 can be connected to the additional condenser 13, the pipe 4 for discharge of a liquid fraction can be connected to the condenser 9 (if the apparatus is connected to the rectifying column 1), and the discharge side of the pump 6 can be connected to the condenser 9.

The pumping-ejection apparatus operates as follows.

A motive liquid is fed by the pump 6 to the nozzle of the liquid-gas ejector 5 through its liquid inlet. The motive liquid flowing from the nozzle of the ejector 5 evacuates a gaseous medium (for example, a gas-vapour mixture) from the source of evacuated gaseous medium (in the given example of application—from the rectifying column 1) through the pipe 3. The liquid and evacuated gaseous medium mix in the flow-through channel of the ejector 5, initiating condensation of easy-condensable components of the gas-vapour mixture and simultaneously providing compression of a gaseous component of the mixture. The gas-liquid mixture formed in the ejector 5 flows into the condenser 9, where condensation of the easy-condensable components is completed. The final composition of the gas-liquid mixture is fixed in the condenser 9 upon completion of the dissolution of the gaseous component in the liquid. Then the mixture passes from the condenser 9 to the separator 7, where the gas-liquid mixture is separated into the motive liquid and compressed gas. The motive liquid is pumped out from the separator 7 by the jet pump 10. A part of the liquid from the discharge side of the pump 6 is fed into the nozzle of the jet pump 10 as the motive fluid. The motive liquid from the jet pump 10 is delivered under required pressure to the suction side of the pump 6, which, in its turn, delivers the motive liquid into the nozzle of the ejector 5.

The additional pump 14 delivers the motive liquid under pressure from the outlet separator 12 into the nozzle of the boosting liquid-gas ejector 11. The motive liquid flowing from the nozzle of the ejector 11 evacuates compressed gas from the separator 7. A gas-liquid mixture is formed in the ejector 11 and further compression of a gaseous component of this mixture takes place. Additionally, in view of an increased pressure, if compared with the pressure in the ejector 5, further condensation of condensable components of the compressed gas received from the separator 7 occurs in the ejector 11. The gas-liquid mixture from the ejector 11 gets into the additional condenser 13, where condensation is completed. Then the gas-liquid mixture flows from the additional condenser 13 into the outlet separator 12, where it is separated into the motive liquid and compressed gaseous medium. The motive liquid from the outlet separator is directed to the suction side of the additional pump 14, which delivers it to the boosting liquid-gas ejector 11. The compressed gaseous medium is discharged from the outlet separator 12 and delivered to consumers.

If the evacuated gas-vapour phase contains a lot of condensable components, which can affect quality characteristics of the motive liquid, there is a possibility to feed an additional amount of the motive liquid into the condensers 9 and 13 by the pump 6 and/or to feed a liquid fraction from the column 1 into the condenser 9.

Such a design of the apparatus ensures more intensive condensation, which is completed before the gas-liquid mixture leaves the condensers 9 and 13. In addition, feed of the motive liquid into the additional condenser 13 by the pump 6 allows transfer of the surplus liquid accumulated due to condensation to the additional vacuum-producing device, wherefrom the surplus liquid is discharged, for example through the outlet separator 12, for further processing. And finally, such a design allows, if it is necessary, make-up of the motive liquid by means of a continuous-flow system feeding the fresh liquid. For example, the make-up can be arranged as follows: the fresh liquid from an external source, for example from the pipe 4, is fed to the condenser 9, where it is mixed with the currently circulating motive liquid. Then a part of this renewed motive liquid from the condenser 9 is fed by the pump 6 into the ejector 5, and another part passes into the additional condenser 13, where it mixes with the motive liquid circulating in the additional vacuum-producing device. After that a surplus amount of the motive liquid, equivalent in total to the amounts of the received, fresh liquid and condensate of the evacuated gas-vapour mixture, is discharged from the apparatus. Thus, it is possible to renew the motive liquid in both vacuum-producing devices simultaneously without outage or stoppage of the apparatus.

INDUSTRIAL APPLICABILITY

This invention can be applied in chemical, petrochemical and some other industries, where vacuum processes are used.

What is claimed is:

1. A pumping-ejection apparatus, including:

a vacuum-producing device having:

a first liquid-gas ejector having a gas inlet connected to a pipe for feed of an evacuated gaseous medium;

a first separator having a pipe for discharge of compressed gas; and a first pump having a discharge side connected to a liquid inlet of the liquid-gas ejector;

the pumping-ejection apparatus further comprising:

a first condenser;

a jet pump; and an additional vacuum-producing device including a boosting liquid-gas ejector, an outlet separator, an additional condenser and an additional pump;

said jet pump includes:

an evacuated medium inlet connected to the first separator, an outlet connected to a suction side of the first pump, and a motive medium inlet connected to the discharge side of the first pump;

said first condenser includes:

an inlet connected to an outlet from the first liquid-gas ejector, and an outlet connected to the first separator;

said boosting liquid-gas ejector includes:

a gas inlet connected to the pipe for discharge of compressed gas, a liquid inlet connected to a discharge side of the additional pump, an outlet connected to an inlet of the additional condenser; and said outlet separator is connected to an outlet of the additional condenser and connected to a suction side of the additional pump.

2. The apparatus according to claim 1, wherein the discharge side of the first pump is connected to the additional condenser.

3. The apparatus according to claim 1, wherein the discharge side of the first pump is connected to said first condenser.

* * * * *